US005911666A

United States Patent [19]

Lancaster, III et al.

[11] Patent Number: 5,911,666

[45] Date of Patent: Jun. 15, 1999

[54] METHOD AND APPARATUS FOR DISPOSING OF PACKAGING MATERIAL

[75] Inventors: Patrick R. Lancaster, III, Louisville, Ky.; Steven E. Degrasse, New Albany, Ind.

[73] Assignee: Lantech Management Corp. and Lantech Holding Corp., Louisville, Ky.

[21] Appl. No.: 08/873,397

[22] Filed: Jun. 12, 1997

[51] Int. Cl.[6] ..... B65B 43/26

[52] U.S. Cl. ..... 53/492; 53/381.2; 53/381.1; 414/412

[58] Field of Search ..... 53/492, 381.1, 53/381.2; 414/412

[56] References Cited

U.S. PATENT DOCUMENTS

| | | | |
|---|---|---|---|
| 5,282,346 | 2/1994 | Masuda et al. | 53/492 X |
| 5,425,219 | 6/1995 | Tanaka et al. | 53/381.2 X |
| 5,727,747 | 3/1998 | Hannen et al. | 53/492 X |

FOREIGN PATENT DOCUMENTS

| | | | |
|---|---|---|---|
| 2463726 | 4/1981 | France | 53/381.1 |
| 1511847 | 1/1970 | Germany | 53/381.1 |
| 4201829 | 7/1992 | Japan | 53/381.1 |

OTHER PUBLICATIONS

MSK Covertech Informational Flyer.

*Primary Examiner*—Linda Johnson
*Attorney, Agent, or Firm*—Finnegan, Henderson, Farabow, Garrett & Dunner, L.L.P.

[57] ABSTRACT

Plastic packaging material on a wrapped load is disposed of by applying a stream of air to a selected region of the packaging material on the load at a sufficient temperature, volume, and velocity and causing to weaken and the packaging material to be separated in the selected region, separating the plastic packaging material along the selected region and removing the plastic packaging material from the load. The invention may further include winding up the severed packaging material, and forming a rolled bale of packaging material removed from several loads.

31 Claims, 7 Drawing Sheets

METHOD AND APPARATUS FOR DISPOSING OF PACKAGING MATERIAL

BACKGROUND OF THE INVENTION

The invention relates to methods and apparatus for disposing of packaging material wrapped on a load.

DESCRIPTION OF THE RELATED ART

Products are stacked on a pallet to form a load and wrapped with stretch wrap packaging material to protect them and to provide stability during shipping. The web of plastic stretch wrap packaging material is elastically stretched, sometimes even beyond its elastic limit, and applied under tension to a load of unit products, the tension of the wrap serving to bind the unit products together as a load. Since the packaging material is applied under tension, the packaging material will attempt to return to its original length when released or cut. Once the products have been shipped, it is necessary to dispose of the packaging material.

Conventional methods include pulling the film away from the load and cutting the film with a knife or hot wire, and then pulling the wrap off the load. Alternatively, the packaging material on the load is cut into several pieces. The packaging material is sometimes processed in a secondary operation that uses a compactor to form a bale of compressed packaging material by compressing packaging material removed from a number of loads and banding or otherwise securing the packaging material in this compacted state. This process requires the packaging material to be secured in this compacted state to prevent it from expanding to its original uncompacted volume.

SUMMARY OF THE INVENTION

There is a need for a method and apparatus that can dispose of packaging material wrapped on a load in a simple, reliable and cost effective manner without damaging the load.

Additional features and advantages of the present invention will be set forth in the description which follows, and in part will be apparent from the description, or may be learned by practice of the invention. The objectives and advantages of the invention will be realized and attained by means of the elements and combinations particularly pointed out in the appended claims.

To achieve these and other advantages, a method and apparatus is provided for disposing of stretch wrap packaging material on a stretch wrapped load.

According to one aspect of the invention, the method and apparatus includes applying a stream of air to the stretch wrap packaging material on the stretch wrapped load in a selected region at a sufficient temperature, volume, and velocity to weaken and enable the wrapped stretch wrap packaging material to be separated in the selected region, separating the stretch wrap packaging material along the selected region, and removing the stretch wrap packaging material from the load.

According to another aspect of the invention, the method and apparatus includes separating the stretch wrap packaging material from a stretch wrapped load along a selected region, removing stretch wrap packaging material from a plurality of loads, and forming a bale of stretch wrap packaging material from the stretch wrap packaging material removed from a plurality of loads by winding up the stretch wrap packaging material from a plurality of loads.

It is to be understood that both the previous general description and the following detailed description are exemplary and explanatory only and are not restrictive of the invention as claimed.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Examples of the present preferred embodiments of the invention are illustrated in the accompanying drawings. Wherever possible, similar reference numbers will be used throughout the drawings to refer to similar parts.

Figure 1:
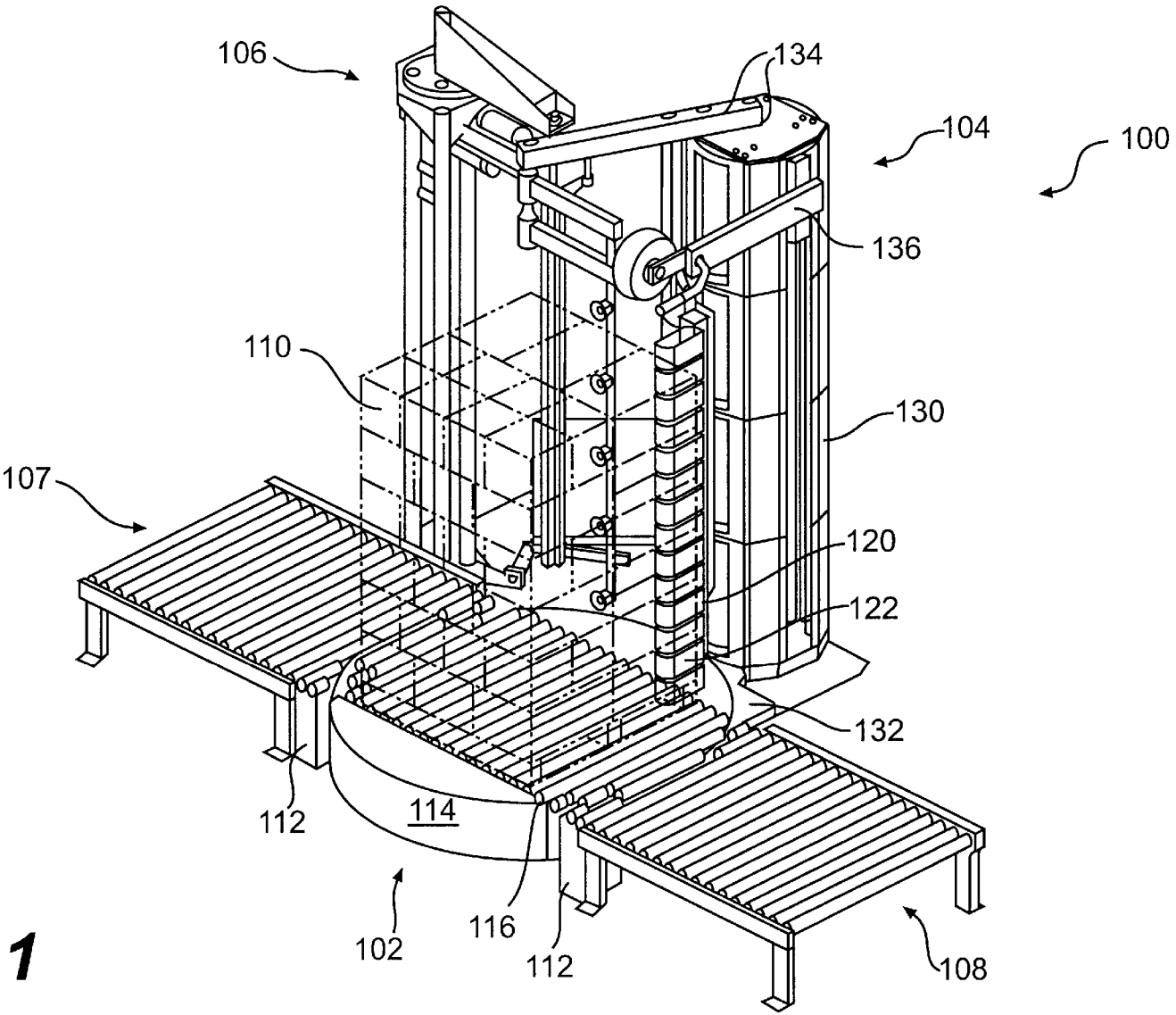
FIG. 1 is a perspective view of an apparatus for disposing of plastic packaging material incorporating the teachings of the present invention.
Figure 2:
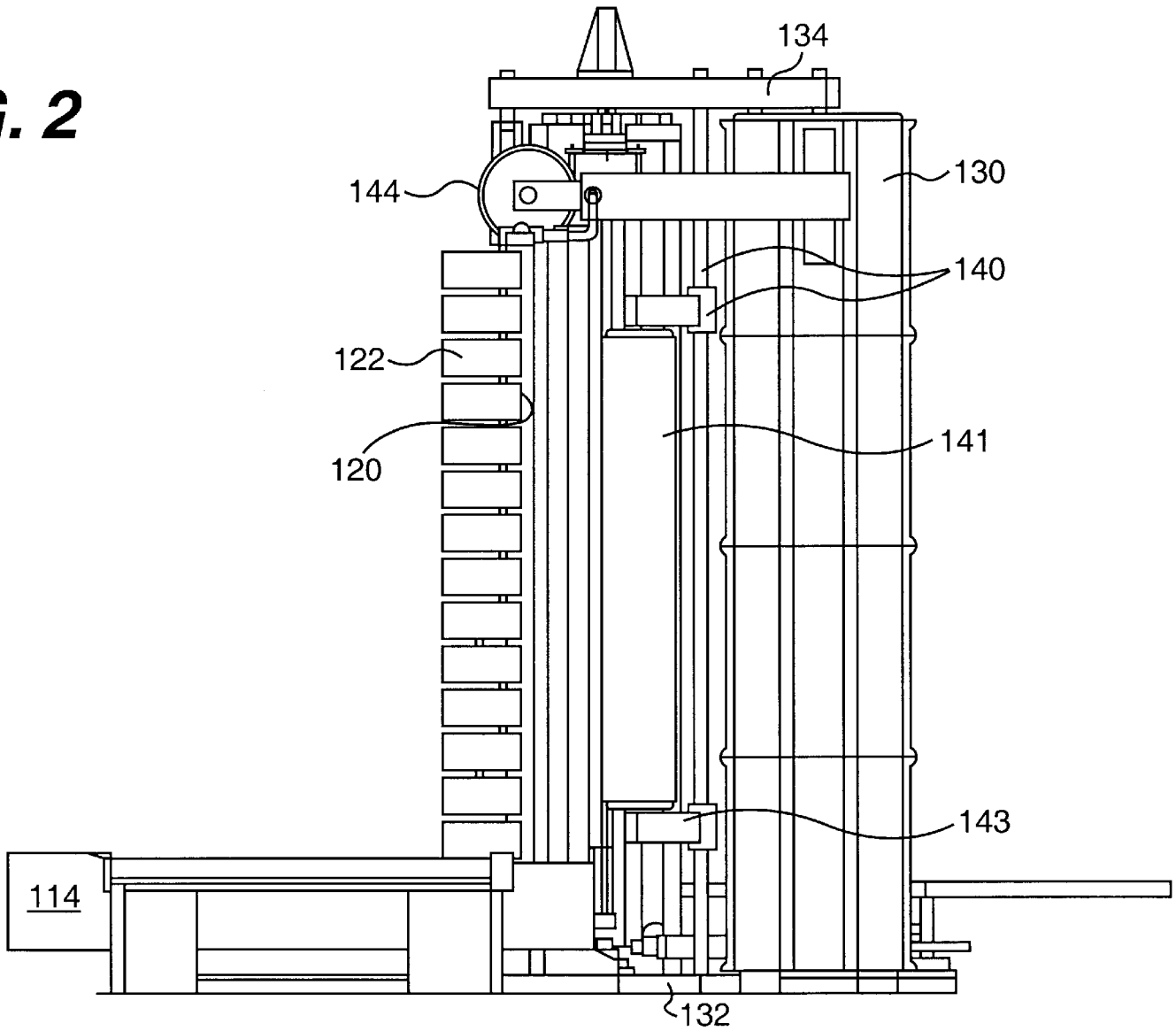
FIG. 2 is a side view of the apparatus of FIG. 1.

According to the present invention an apparatus and method is provided for disposing of plastic packaging material on a wrapped load. An embodiment of the present invention is shown in FIG. 1 in the form of an assembly line apparatus 100 for disposing of plastic packaging material on a wrapped load.

Apparatus 100 includes an infeed conveyor 107 and exit conveyor 108 serve to transport a load 110 wrapped with a plastic stretch wrap packaging material 125 to apparatus 100 and transport load 110 after unwrapping from apparatus 100. Transfer roller units 112 are located between infeed conveyor 106 and turntable 114 and between exit conveyor 108 and turntable 114. Transfer roller units 112 serve to assist in transition of load 110 on and off of turntable 114. Alternatively, load 110 may be conveyed by other means such as a belt conveyor, shuttle car, fork truck or pallet jack.

According to one aspect of the present invention, means are provided for applying a stream of air to stretch wrap packaging material on a stretch wrapped load at a sufficient temperature, volume, and velocity to weaken and enable the stretch wrap packaging material to be separated in a selected region. As embodied in FIGS. 1 and 3, the means for applying a stream of air includes a blower 142, such as a motor and fan, a source of compressed air, or another air pump arrangement.

Blower 142 may provide a single stream of air or multiple streams of air. Blower 142 may be a single blowing unit of small dimensions, a series of small blowing units, or a single long plenum blowing unit which spans the height of a load. Any of these arrangements may be used to weaken and separate the stretch wrap packaging material along the selected region, which in the typical case is the full height of the stretch wrap packaging material on the load, but may in some instances be a shorter region.

The stream of air may weaken and enable the stretch wrap packaging material to be separated in the selected region by rupturing it outright or by allowing it to be simultaneously or subsequently separated by another operation, such as manually or mechanically pulling on the stretch wrap packaging material. When the tensioned stretch wrap packaging material ruptures along the selected region, the edges of the ruptured area spring back from each other because of the elasticity of the tensioned stretch wrap packaging material.

According to one aspect of the invention, a heater, such as an electrically-powered resistance wire coil heater, is provided to heat the stream of air to a desired temperature, sufficient to at least weaken stretch wrap packaging material at the selected location.

As shown in the drawing, the heater may be a part of blower 142, which may be configured like a hair dryer. The temperature may be high enough to rupture all layers of stretch wrap packaging material 125 at the selected region. Generally, it is preferable to heat the stretch wrap packaging material to a temperature of at least about 170° F., where its integrity becomes compromised. The temperature should not exceed about 230° F., where fire may possibly occur.

The heating of the air is in contrast to the conventional use of hot wires that directly contact and melt the stretch wrap packaging material. The present invention permits the stretch wrap packaging material to be severed while diminishing the concern for damaging the load. This aspect of the invention uses convection of the air between the heater and the packaging material to heat the packaging material. The heated air is transported to contact the packaging material such that it contacts the packaging material before the air falls below an effective temperature.

According to one aspect of the invention, the stretch wrap packing material may remain in place in its original wrapped orientation while being weakened and separated, and does not need to be lifted away from the load before and while doing so.

While it is currently preferable to use a heated stream of air, it is also contemplated, according to other aspects of the invention, to increase other parameters of the stream of air, such as velocity and volume, to weaken the stretch wrap packaging material along the selected region.

In addition, while the invention is particularly addressed to and adapted for stretch wrapping and stretch wrap packaging material, it may be possible to apply it as well to other packaging material such as netting, shrink wrap, and other plastic packaging material.

Figures 3A, 3B:
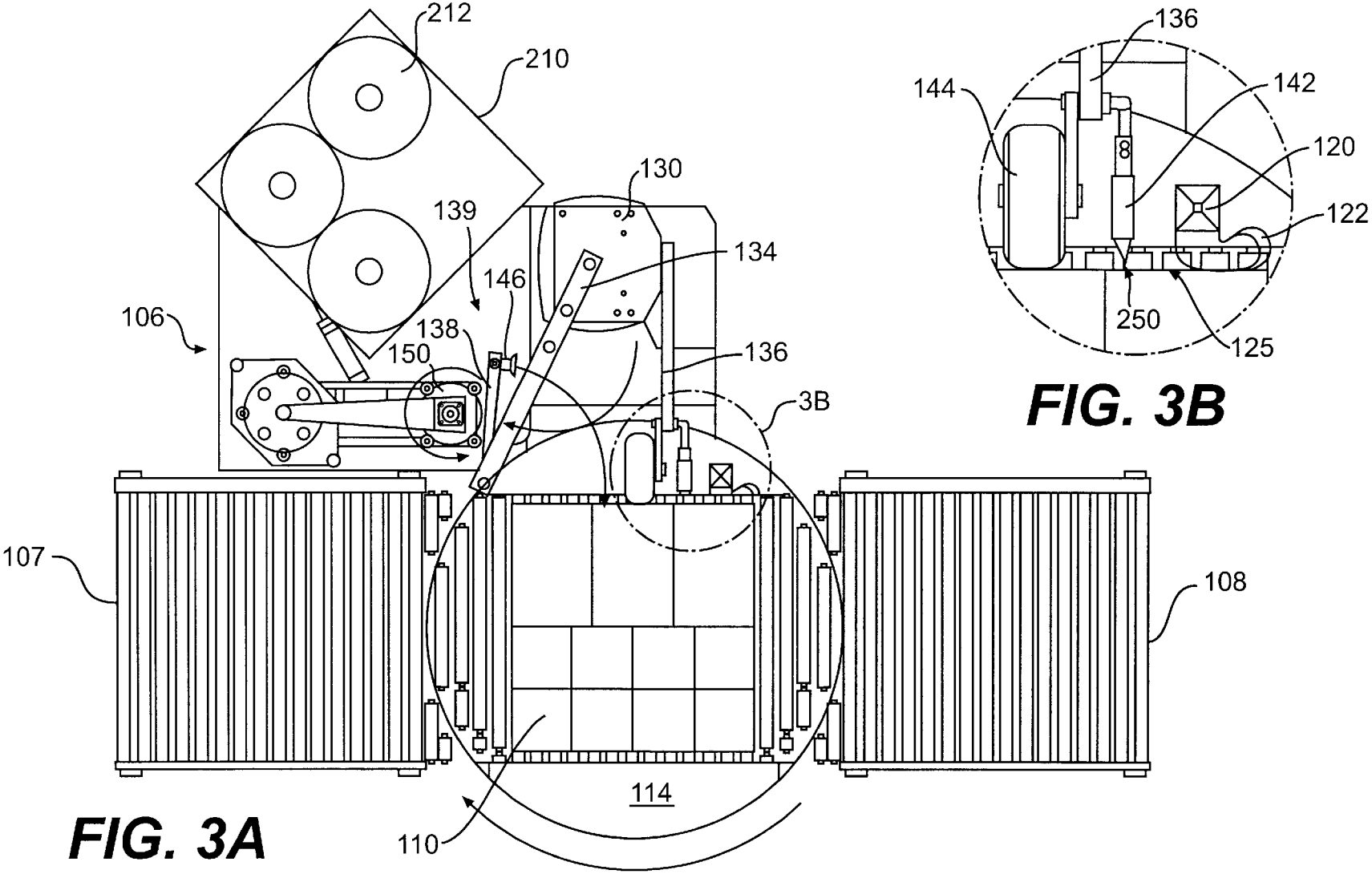
FIG. 3A is a top view of the apparatus of FIG. 1 showing the interaction of the components of the system.
FIG. 3B is a detailed top view of a subassembly of the apparatus as shown in FIG. 3A.
Figure 4A:
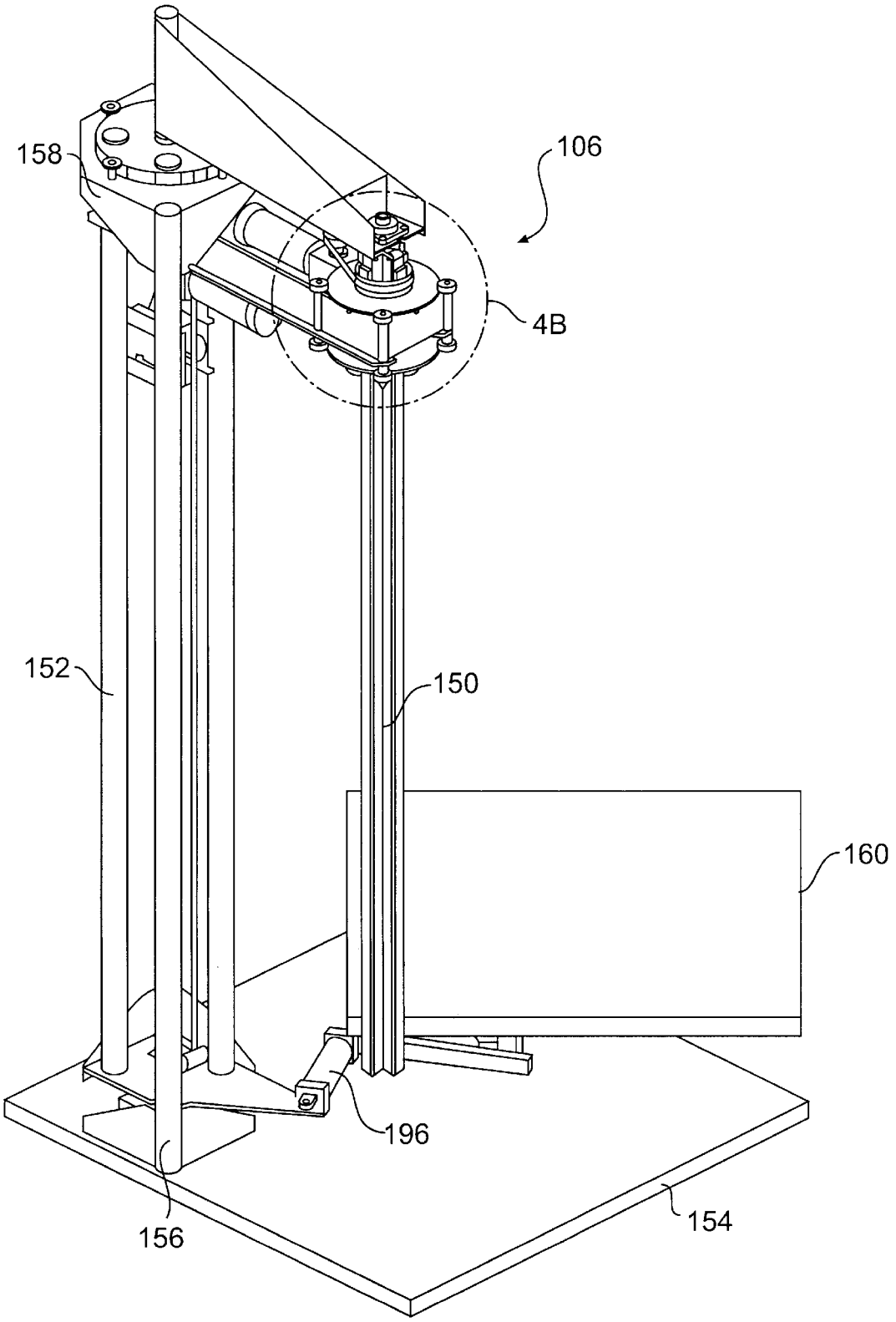
FIG. 4A is a perspective view of a subassembly of the apparatus shown in FIG. 1.
Figure 4B:
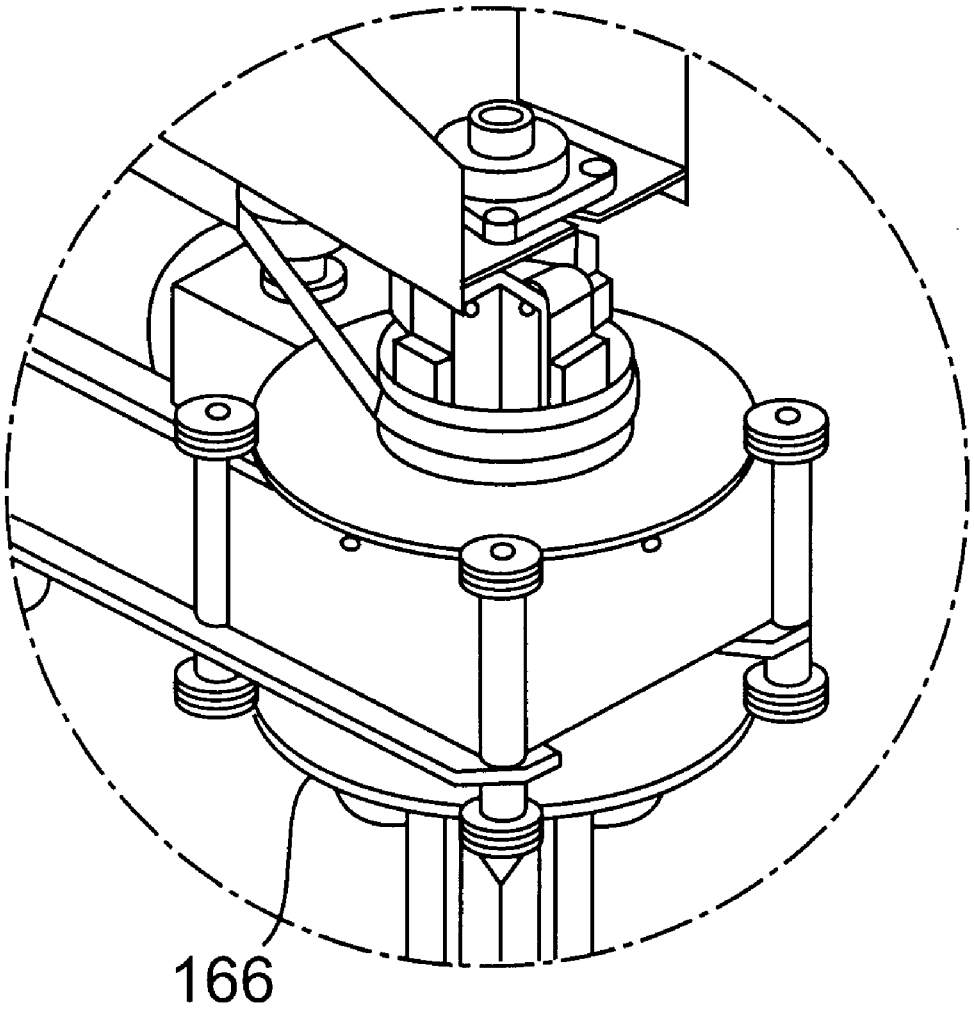
FIG. 4B is a detailed perspective view of a portion of the subassembly of FIG. 4A.
Figure 5B:
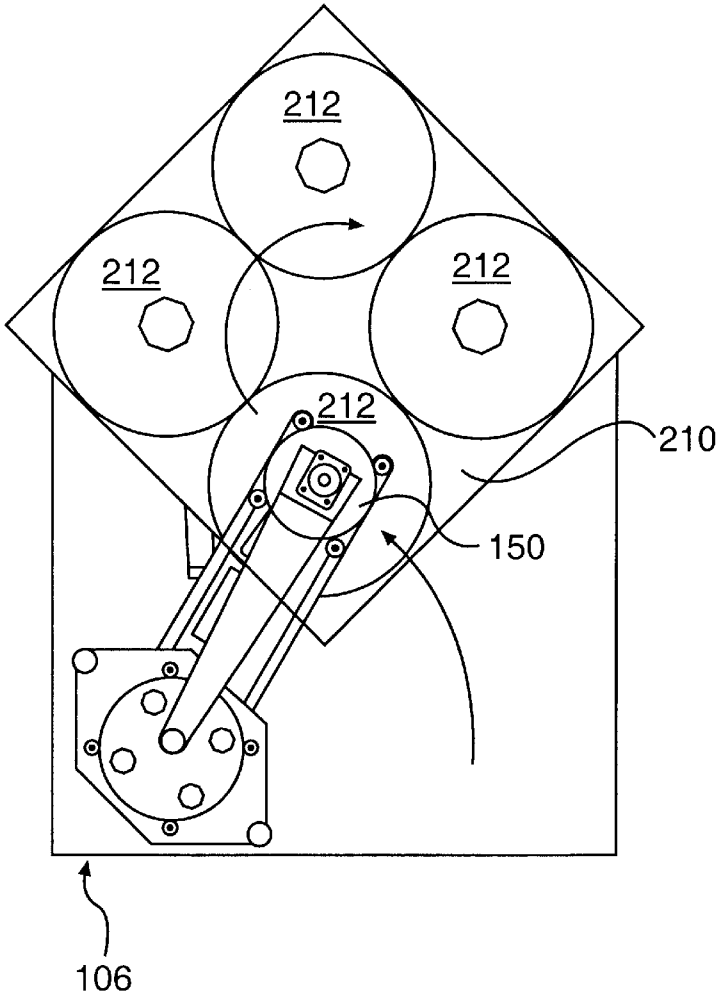
FIGS. 5A and 5B are top views of the subassembly of FIG. 4A in operation.
Figure 5A:
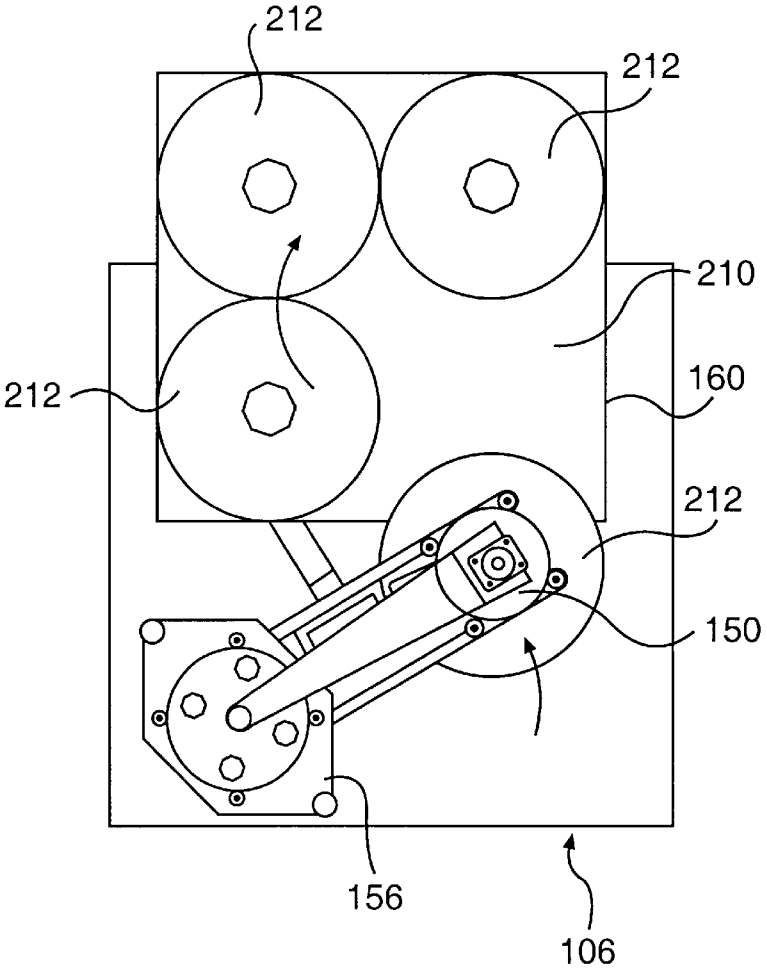
Figure 6:
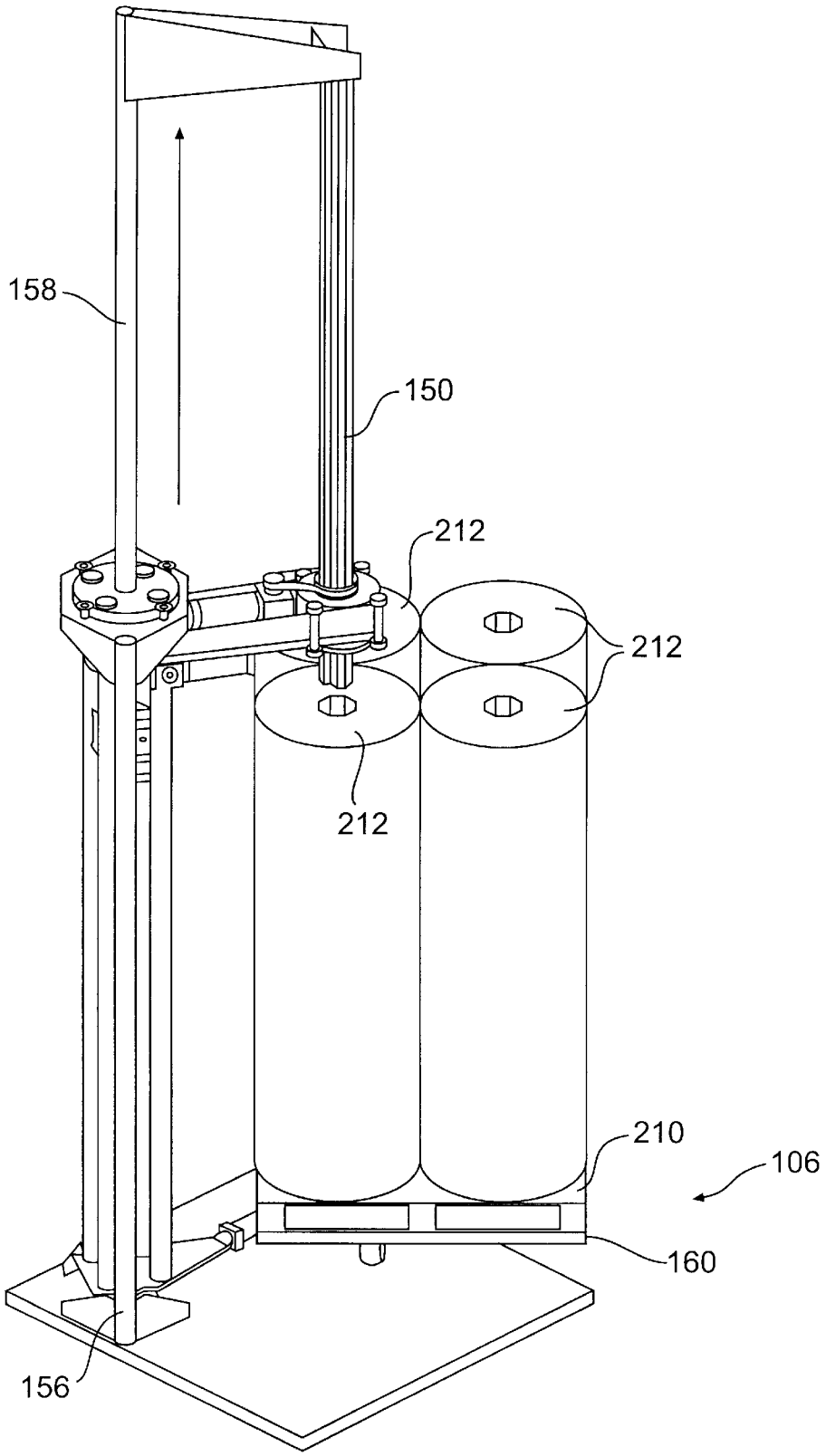
FIG. 6 is a perspective view of the subassembly of FIG. 4A in operation.

According to the present invention, the means for applying a stream of air may include means for moving the applying means along the selected region to apply the stream of air to different parts of the selected region at different times. As seen in the embodiment of FIGS. 1, 3A, and 3B, the means for moving the applying means may include first arm 136, which is connected to blower 142 and vertically displaceable along mast assembly 104 by a lifting structure such as a motor driven belt, a pulley assembly, or a gear mechanism. This structure allows blower 142 to move vertically along the entire length of the selected region of stretch wrap packaging material 125.

By moving vertically along the height of load 110, blower 142 can direct a stream of air 250 of sufficient volume, velocity and temperature along the entire length of the selected region of stretch wrap packaging material 125 in order to weaken and enable stretch wrap packaging material 125 to be separated along its entire length in the selected region. The position of blower 142 relative to the selected region of stretch wrap packaging material 125 is maintained by a guide wheel 144 which is also mounted on first arm 136 and is aligned to be vertically displaceable with blower 142. Various other mechanisms may be used for moving the blower.

A less preferred way of weakening the packaging material is to expose the packaging material to infrared radiation without contacting the packaging material with the source of the infrared radiation and without using convection by applying a stream of air. This procedure is less preferred because accuracy of placement is critical in controlling the distance between the infrared source and the packaging material and in controlling the temperature of the packaging material in order to effectively weaken the packaging material in a reasonably short period of time without damaging the load or causing the packaging material to catch on fire. This accuracy of placement and regulation of temperature is particularly a concern when the packaging material is in contact with the load in some places and not in others because the packaging material heats at a different rate depending on whether it is in contact with the load.

According to another aspect of the invention, means are provided for separating the packaging material on a stretch wrapped load along a selected region. As embodied in FIGS. 1, 3A, and 3B, the means for separating the packaging material from the load includes blower 142, as described above. Alternatively, the means for separating the packaging material on a load may include a pulling mechanism, a knife or other slicing mechanism or a hot wire.

According to another aspect of the invention, means are provided for removing stretch wrap packaging material from the load. As embodied in FIGS. 1 and 3A, the means for removing stretch wrap packaging material includes an arm assembly 139 having engagement means including a second arm 138 and suction cups 146.

Second arm 138 includes vacuum operated suction cups 146 for engaging packaging material 125. Second arm 138 is pivotally connected to a top frame 134 of mast assembly 104 and is actuated by a motor within mast assembly 104, allowing second arm 138 to move toward and away from load 110 to transfer packaging material 125 away from load 110. As packaging material 125 on wrapped load 110 is weakened by blower 142, second arm 138 is moved by the motor to engage packaging material 125 by placing suction cups 146 in contact with packaging material 125 adjacent the selected region and turning on the vacuum. After engaging packaging material 125, second arm 138 pivots, moving away from load 110 while still engaging packaging material 125, thereby effectively transferring packaging material 125 away from load 110. To release packaging material 125, the vacuum to suction cups 146 is cut off.

The removing means alternatively may include other arrangements such as frames, flexible members, or arms having a different configuration. These alternatives may use suction cups 146 to engage packaging material 125, or alternative engagement means such as mechanical fingers, pinchers or graspers, or "sticky" sections may be employed to engage and transfer the packaging material 125 away from load 110. Alternatively, the packaging material may be weakened, separated and/or removed manually by an operator.

As embodied in FIGS. 1 and 3A, the means for removing the packaging material from the load may also include a structure for supporting and/or rotating the load such as turntable assembly 102. Turntable assembly 102 includes a turntable 114 including chain driven rollers 116 for conveying load 110 into place. A pole 120 is mounted on turntable 114 and includes flaps 122. Flaps 122 are mounted on pole 120 in order to hold stretch wrap packaging material 125 (see FIG. 3) against load 110 until the stretch wrap packaging material is removed from load 110. Turntable assembly 102 is mounted on a ball bearing assembly and is rotated by a drive motor located inside mast assembly 104.

Means may be used to hold a portion of stretch wrap packaging material while another portion of the stretch wrap packaging material is removed from the load, so the stretch wrap packaging material does not fall away from the load when it is severed. The means may include flaps 122, loops, strips or other members mounted on the turntable and made of any suitable flexible material such as rubber or plastic. Flaps 122 may be replaced with a suitable alternative for holding packaging material 125 in place such as a foam pad, inflatable bumper, or clamp.

As embodied in FIGS. 1 and 3A, once the severed edge of stretch wrap packaging material 125 is transferred away from load 110, the remainder of stretch wrap packaging material 125 surrounding load 110 is removed. While the severed end of stretch wrap packaging material 125 is engaged by second arm 138 and suction cups 146 away from load 110, turntable assembly 102 is actuated by a controller to remove stretch wrap packaging material 125 from load 110.

According to another aspect of the present invention, the means for removing may include means for collecting the packaging material removed from the load. As seen in the embodiment of FIGS. 1, 3A, and 4A–6, the means for collecting the stretch wrap packaging material removed from the load may include a structure for receiving the packaging material, such as a mandrel assembly 106. Mandrel assembly 106 may include a vertically displaceable mandrel 150 within mandrel assembly 106 which is connected to a mandrel mast 152 pivotally mounted to a base frame 154 of mandrel assembly 106. Mandrel mast 152 houses a lift drive 162 for vertically displacing mandrel 150, a rotation drive 164 for rotating mandrel 150, and a mount ring 166 through which mandrel 150 passes.

Mandrel 150 can receive packaging material 125 from arm assembly 139 as arm assembly 139 pivots away from load 110 with packaging material 125. Stretch wrap packaging material 125 may be held to mandrel 150 by fingers, clamps, or clasps on mandrel 150, heated portions of mandrel 150, a severed edge of stretch wrap packaging material 125 may be physically pushed into an open portion or slot of mandrel 150 by some means, or mandrel 150 may use a vacuum to engage packaging material 125. Mandrel 150 may be a reusable, collapsible or telescoping mandrel, a power actuated mandrel, a manually driven mandrel, or a single use disposable mandrel. Mandrel 150 may be stationary or rotatable about turntable 114.

While it is currently preferable to use a mandrel to receive and collect the packaging material, it is also contemplated, according to other aspects of the invention, to use other means to collect the packaging material such as a collection bin, a vacuum collection system, a stacking system for stacking the used packaging material, or a hanging system including pegs upon which the used packaging material can be impaled. The packaging material may also be collected manually.

As seen in the embodiment of FIGS. 1–3A, the means for collecting stretch wrap packaging material removed from the load may also include a structure for engaging and holding the packaging material to the packaging material receiving structure once second arm 138 has transferred packaging material 125 from load 110 such as tension roller arm 140. As embodied in FIG. 2, tension roller arm 140 includes roller 141 with arm assembly 143 and tension roller arm 140 is mounted to and pivots off top frame 134 of mast assembly 104. Tension roller arm 140 is controlled by a motor within mast assembly 104 and moves to engage packaging material 125 and pushes and holds it against the packaging material receiving structure as second arm 138 releases packaging material 125. Additionally, tension roller arm 140 may include structure for attaching packaging material 125 to the packaging material receiving structure before releasing packaging material 125 such as projections which can be actuated to push the packaging material into a receiving area on the packaging material receiving structure.

According to another embodiment of the invention, the means for collecting the stretch wrap packaging material removed from the load may include means for winding up the packaging material. As embodied in FIGS. 1, 3A, and 4A–6, the means for winding up the packaging material includes mandrel means such as mandrel 150. Mandrel 150 receives packaging material 125 when it is transferred from load 110 and packaging material 125 may be wound around mandrel 150.

Means may be used to attach the packaging material to the winding up means before winding, so the stretch wrap packaging material is held tightly and does not slip during the winding process. The means may include fingers, clamps, or clasps on mandrel 150, heated portions of mandrel 150, suctioning means on mandrel 150, or an open slot on mandrel 150 for receiving a portion of the packaging material. Attachment of the packaging material to the winding up means may be controlled automatically or be done manually.

After attaching the packaging material to the winding up means, the winding of packaging material 125 may be initiated by actuation of a controller which actuates a rotation drive of mandrel 150, packaging material 125 may be wound manually around mandrel 150, or mandrel 150 may remain stationary while additional means actuated by a controller winds packaging material 125 around mandrel 150.

As shown in FIG. 3A, turntable 114 rotates load 110 to allow stretch wrap packaging material 125 surrounding load 110 to be unwound. After turntable 114 rotates or simultaneously with rotating turntable 114, mandrel 150 rotates such that stretch wrap packaging material 125 winds about mandrel 150. In order to ensure alignment of stretch wrap packaging material 125 as it is wrapped about mandrel 150, tension may be applied to packaging material 125. This tension may result from force applied by tension arm 140 or by flaps 122 holding the portion of packaging material 125 remaining on load 110 in place as packaging material 125 is pulled off load 110. Mandrel 150 rotates until the removed packaging material 125 is completely wound about mandrel 150.

Alternatively, mandrel 150 rotate around a stationary load 110 or may move to load 110 on turntable 114, and rotate against load 110 such that friction between load 110 and rotating mandrel 150 smooths packaging material 125 as it is wrapped and minimizes air and/or debris accumulation between layers of packaging material 125. Also, it is possible to provide an additional pair of rollers which packaging material 125 passes through before being wound onto mandrel 150 in order to minimize air and/or debris accumulation between layers of packaging material 125.

According to one aspect of the present invention, means are provided for forming a rolled bale of packaging material from the packaging material removed from a plurality of loads. The means for forming a rolled bale of packaging material may include means for winding up the removed packaging material as discussed above. Such bales may be about the height of the load or the height of the wrapped packaging material on the load.

As embodied in FIGS. 4A–6, the means for forming a rolled bale may include mandrel assembly 106 with components such as a vertically displaceable mandrel 150 within mandrel assembly 106 which is connected to a mandrel mast 152 pivotally mounted to a base frame 154 of mandrel assembly 106. Mandrel mast 152 houses a lift drive 162 for vertically displacing mandrel 150, a rotation drive 164 for rotating mandrel 150, and a mount ring 166 through which mandrel 150 passes. An air cylinder 196 pivots mandrel mast 152 and mandrel 150 between base frame 154 and a pallet platform assembly 160. Actuation of air cylinder 196 also serves to index pallet platform 160 via a linkage under platform 160. Pallet platform assembly 160 holds a pallet 210 for storage of bales of used packaging material which has been removed from a plurality of loads.

Once mandrel 150 has collected stretch wrap packaging material 125, the process to unwrap a new load 110*a* begins. Stretch wrap packaging material 125*a* off new load 110*a* is wound on top of the previous stretch wrap packaging material 125. The steps of removing the packaging material from a load and winding up the packaging material around mandrel 150 preferably are alternatingly repeated until a rolled bale 212 of stretch wrap packaging material is formed from the stretch wrap packaging material removed from a plurality of loads. Once a bale 212 is formed around mandrel 150, mandrel 150 is pivoted to pallet assembly 160 and deposits bale 212 on pallet 210. Mandrel 150 may collapse upon itself in order to deposit bale 212 on pallet 210. Alternatively, bale 212 may be manually removed from mandrel 150, pallet assembly 160 may include means for gripping bale 212 and removing it from mandrel 150, or mandrel 150 may include power actuated means for pushing bale 212 off of mandrel 150. Disposable mandrels may also be used and remain in the bale.

While it is currently preferable to use a mandrel assembly including a mandrel to form a rolled bale of the packaging material by winding, it is also contemplated, according to other aspects of the invention, that stacks of the packaging material may be formed as the packaging material is removed from the plurality of loads, and the stacks may be formed into bales by rolling, folding, or bunching the packaging material without use of a mandrel. Alternatively, the rolled bale may be manually wound and formed by an operator.

After bale 212 is placed on pallet 210 and mandrel 150 is withdrawn from bale 212, mandrel 150 pivots into position at base frame 154 to receive a new layer of stretch wrap packaging material, and the process of separating, removing and winding the stretch wrap packaging material into a bale for disposal begins anew. Also after bale 212 has been deposited on pallet 210, pallet platform assembly 160 rotates 90 degrees to allow for the next completed bale to be deposited. Once a pallet is completely full, it is unitized by stretch wrapping bales 212 on pallet 210, and unitized pallet 210 is transported and an empty pallet 210*a* is then placed on platform 160 to receive bales 212 of collected stretch wrap packaging material.

It is contemplated that various combinations of the separating means, removing means, collecting means, winding up means and bale forming means may be used to dispose of the packaging material on a load. The entire process may be controlled by a controller such as a microprocessor or electromechanical controller, and individual means may be controlled by the same controller or individual controllers, and some or all of the means may be actuated manually.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of the general inventive concept as defined by the appended claims and the equivalents.

We claim:

1. A method for automatically disposing of stretch wrap packaging material covering the sides of a stretch wrapped load comprising:

automatically applying a stream of air to the stretch wrap packaging material on the stretch wrapped load in a selected region at a sufficient temperature, volume, and velocity to weaken and enable the wrapped stretch wrap packaging material to be separated in the selected region;

automatically separating the stretch wrap packaging material along the selected region; and automatically unitarily removing the stretch wrap packaging material covering the sides of the load from the load.

2. The method of claim 1 including heating the stream of air.

3. The method of claim 1 including heating the stream of air and wherein the stretch wrap packaging material is heated to a temperature of at least about 170° F.

4. The method of claim 1 wherein the stream of air is applied to the selected region at a temperature, volume, and velocity sufficient to rupture all layers of stretch wrap packaging material at the selected region.

5. The method of claim 1 wherein the stretch wrap packaging material is removed from the load by holding a portion of the stretch wrap packaging material while removing another portion of the stretch wrap packaging material from the load.

6. The method of claim 1 including rotating the load while removing the stretch wrap packaging material.

7. The method of claim 1 including rotating the load on a turntable and holding a portion of the stretch wrap packaging material while unwrapping another portion of the stretch wrap packaging material.

8. The method of claim 1 including automatically forming a rolled bale of stretch wrap packaging material removed from a plurality of loads by winding up the stretch wrap packaging material as it is removed from the plurality of loads.

9. The method of claim 1 including moving the stream of air along the selected region to apply the stream of air to different parts of the selected region at different times.

10. A method for automatically disposing of stretch wrap packaging material wrapped on a stretch wrapped load comprising:

automatically removing stretch wrap packaging material from a plurality of stretch wrapped loads; and automatically forming a rolled bale of stretch wrap packaging material removed from a plurality of loads by winding up the stretch wrap packaging material as it is removed from the plurality of loads.

11. The method of claim 10 including alternating the removing and winding.

12. The method of claim 10 including winding up the removed stretch wrap packaging material from each of the plurality of loads around a mandrel to form the rolled bale.

13. The method of claim 12 including alternating the removing and winding.

14. The method of claim 10 including automatically forming a plurality of rolled bales, each rolled bale having stretch wrap packaging material removed from a plurality of loads, and unitizing the plurality of bales to form a load.

15. The method of claim 14 wherein the bales are unitized by stretch wrapping them.

16. An apparatus for automatically disposing of stretch wrap packaging material covering the sides of a stretch wrapped load comprising:

means for automatically applying a stream of air to the stretch wrap packaging material on the wrapped load in a selected region at a sufficient temperature, volume and velocity to weaken and enable the stretch wrap packaging material to be separated in the selected region; and means for automatically unitarily removing the stretch wrap packaging material covering the sides of the load from the load.

17. The apparatus of claim 16 including means for heating the stream of air.

18. The apparatus of claim 16 including means for moving the applying means along the selected region to apply the stream of air to different parts of the selected region at different times.

19. The apparatus of claim 16 wherein the means for removing the stretch wrap packaging material includes means for winding up the stretch wrap packaging material as it is removed from the load.

20. The apparatus of claim 19 including means for attaching the stretch wrap packaging material to the winding up means.

21. The apparatus of claim 16 including means for holding a portion of stretch wrap packaging material while another portion of the stretch wrap packaging material is removed from the load.

22. The apparatus of claim 16 including a turntable for rotating the load while removing the stretch wrap packaging material.

23. An apparatus for disposing of stretch wrap packaging material on a wrapped load comprising:

means for separating the stretch wrap packaging material on a stretch wrapped load along a selected region;

means for forming a rolled bale of stretch wrap packaging material from the stretch wrap packaging material removed from a plurality of loads including means for winding up the stretch wrap packaging material as it is removed from the plurality of loads.

24. The apparatus of claim 23 wherein the winding up means including mandrel means for receiving and collecting the stretch wrap packaging material removed from the load.

25. The apparatus of claim 23 including means for alternating the operation of the means for separating and the means for winding up.

26. A method for disposing of plastic packaging material covering the sides of a wrapped load comprising:

applying a stream of air to the plastic packaging material on the wrapped load in a selected region at a sufficient temperature, volume, and velocity to weaken and enable the wrapped stretch wrap packaging material to be separated in the selected region;

separating the plastic packaging material along the selected region; and unitarily removing the stretch plastic packaging material covering the sides of the load from the load.

27. The method of claim 26 including heating the stream of air.

28. A method for disposing of plastic packaging material wrapped on a load comprising:

removing plastic packaging material from a plurality of wrapped loads; and forming a rolled bale of plastic packaging material removed from a plurality of loads by winding up the plastic packaging material as it is removed from the plurality of loads.

29. An apparatus for disposing of plastic packaging material covering the sides of a wrapped load comprising:

means for applying a stream of air to the plastic packaging material on the wrapped load in a selected region at a sufficient temperature, volume and velocity to weaken and enable the plastic packaging material to be separated in the selected region; and means for unitarily removing the plastic packaging material covering the sides of the load from the load.

30. The apparatus of claim 29 including means for heating the stream of air.

31. An apparatus for disposing of plastic packaging material on a wrapped load comprising:

means for separating the plastic packaging material on a wrapped load along a selected region; and means for forming a rolled bale of plastic packaging material from the plastic packaging material removed from a plurality of loads including means for winding up the plastic packaging material as it is removed from the plurality of loads.

* * * * *